US005448235A

United States Patent [19]

O'Neill, Jr. et al.

[11] Patent Number: 5,448,235

[45] Date of Patent: Sep. 5, 1995

[54] SINGLE LASER METHOD AND SYSTEM FOR MARINE CHANNEL MARKING

[75] Inventors: Robert O'Neill, Jr., Mystic; Judith B. Snow, Branford, both of Conn.

[73] Assignee: The United States of America as represented by the Secretary of the Navy, Washington, D.C.

[21] Appl. No.: 116,592

[22] Filed: Aug. 30, 1993

[51] Int. Cl.[6] ..... G08G 3/00

[52] U.S. Cl. ..... 340/985; 340/956; 342/54

[58] Field of Search ..... 340/985, 984, 947, 952, 340/953, 956; 342/33, 54; 356/141; 441/13, 16; 116/26, 107

[56] References Cited

U.S. PATENT DOCUMENTS

| | | | |
|---|---|---|---|
| 2,570,138 | 10/1951 | MacKay | 340/956 |
| 3,139,604 | 6/1964 | Meiners et al. | 340/953 |
| 3,191,146 | 6/1965 | Mitchell | 340/956 |
| 3,354,428 | 11/1967 | Projector et al. . | |
| 3,370,269 | 2/1968 | Jasper | 340/985 |
| 3,510,834 | 5/1970 | Durand | 340/956 |
| 3,781,786 | 12/1973 | Larrimore . | |
| 4,196,346 | 4/1980 | McElhannon | 340/952 |
| 4,847,481 | 7/1989 | Altmann | 340/956 |
| 5,043,726 | 8/1991 | Shifrin | 340/953 |
| 5,287,104 | 2/1994 | Shemwell | 340/952 |

OTHER PUBLICATIONS

"Glissada Laser Landing System", Sov. J. Quantum Electron., Jun. 1978, pp. 807–808.

*Primary Examiner*—Brent Swarthout
*Attorney, Agent, or Firm*—Michael J. McGowan; Prithvi C. Lall; Michael F. Oglo

[57] ABSTRACT

A method and system are provided for marking marine channels. A single laser beam is selectively interrupted to produce an identifying on/off laser beam sequence distinguishable by the human eye. The laser beam is then expanded in terms of beam diameter during specifically timed periods of laser beam transmission. The expanded laser beam is projected along a beam path that is substantially along the center of a marine channel to be marked at a height above the water's surface. The height of the beam path is selected such that marine traffic may pass under the beam path without obstructing same.

11 Claims, 2 Drawing Sheets

SINGLE LASER METHOD AND SYSTEM FOR MARINE CHANNEL MARKING

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1. Field of the Invention

The present invention relates generally to maritime navigational aids, and more particularly to a method and system for marine channel marking utilizing a single laser.

2. Description of the Prior Art

Marine channel marking for the purpose of navigation is currently accomplished by a variety of methods and systems. In the traditional system, buoys with flashing green or red lights mark the sides of the channel. The major shortcoming of this simple system is its inability to provide a ship's navigator with the proper bearing to steer through the channel. Rather, the navigator must pick his way through the channel as he visually encounters each buoy.

Another approach uses single station range lights which project a cone of light about a centerline of a marine channel. Different color light is visible from either side of the cone's centerline. The cone of light is further coded in such a way that the navigator can tell if he is near the centerline or the edge of the cone. Example of single station range light systems are disclosed in U.S. Pat. Nos. 3,354,428 and 3,781,786. However, the major shortcoming of these systems is that the navigator must actually be in the cone of light and be looking in the proper direction to use it as a navigation aid. Thus, this approach is only useful once the navigator is able to enter the channel in the first place, which may itself prove to be a difficult task.

Multiple color laser systems are currently being evaluated by the U.S. Coast Guard. Specifically, laser beams are projected above the water's surface to define the edges of a marine channel and/or its center. The use of different color lasers is being considered as a way of distinguishing one beam from another. However, the shortcomings of this approach include the need for several different types of lasers to produce the required colors and the fact that not all colors are equally visible to the human eye, especially against the variety of background lighting conditions normally experienced in coastal areas.

SUMMARY OF THE INVENTION

Accordingly, an object of the present invention is to provide a method and system for marking marine channels. Another object of the present invention is to provide a method and system for marking marine channels with a highly visible light.

Yet another object of the present invention is to provide a method and system for marking marine channels that indicates the channel's bearing to one inside or outside of the channel.

Still another object of the present invention is to provide a method and system of marking a marine channel for purposes of identifying same.

Other objects and advantages of the present invention will become more obvious hereinafter in the specification and drawings.

In accordance with the present invention, a method and system are provided for marking marine channels. A laser beam is generated and selectively interrupted to produce an identifying on/off laser beam sequence distinguishable by the human eye. The on/off laser beam sequence is defined by specifically timed periods of laser beam transmission separated by specifically timed periods of laser beam interruption. The laser beam is then expanded in terms of beam diameter during the specifically timed periods of laser beam transmission. The expanded laser beam is projected along a beam path that is substantially above and parallel to the center of a marine channel to be marked at a height above the water's surface. The height of the beam path is selected such that marine traffic may pass under the beam path without obstructing same.

BRIEF DESCRIPTION OF THE DRAWING(S)

Other objects, features and advantages of the present invention will become apparent upon reference to the following description of the preferred embodiments and to the drawings, wherein.

DESCRIPTION OF THE PREFERRED EMBODIMENT(S)

Figure 1:
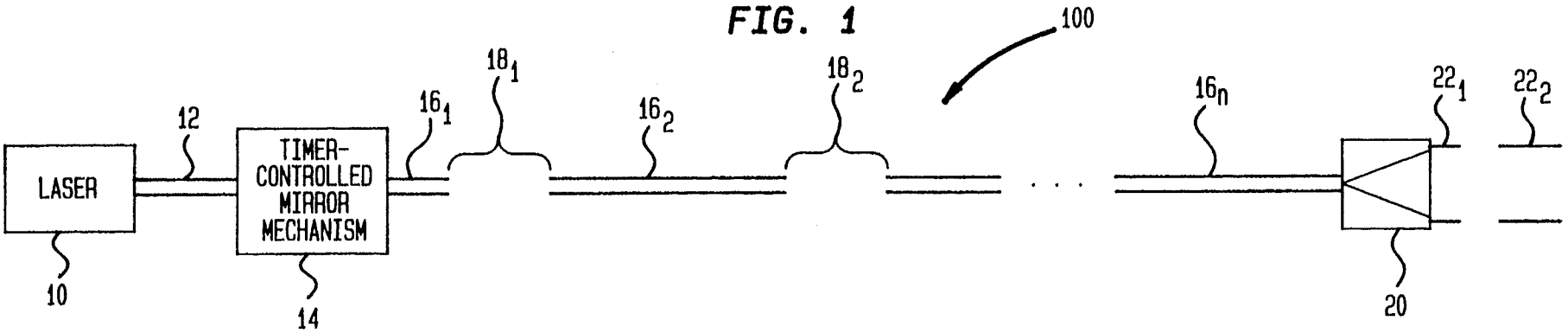
FIG. 1 is a functional block diagram of a single laser system used for marking marine channels in accordance with the present invention.

Referring now to the drawings, and more particularly to FIG. 1, a functional block diagram of a single laser system for marking marine channels is shown and referenced generally by numeral 100. System 100 includes a laser 10 that outputs a continuous wave laser beam 12. Laser 10 may comprise any conventional visible spectrum laser that is well known in the art. However, for reasons that will be explained further hereinbelow, laser 10 preferably outputs laser beam 12 having a wavelength in the range of 475–540 nanometers (i.e., the color blue/green).

Laser beam 12 is the input for a timer-controlled movable mirror mechanism 14 that functions to (1) allow laser beam 12 to pass through unobstructed ("beam on") or (2) deflect laser beam 12 into a beam absorber within mirror mechanism 14 ("beam off"). Such mirror mechanisms are well known in the art. Output from mirror mechanism 14 is a sequence of laser beam transmissions $\mathbf{16}_1$, $\mathbf{16}_2$, . . . $\mathbf{16}_i$, where i is the number of laser beam transmissions associated with a given sequence. The length of each transmission $\mathbf{16}_1$, $\mathbf{16}_2$, . . . , is indicative of a time duration of the respective transmission. Separating each laser beam transmission is a laser beam interruption generally indicated as $\mathbf{18}_1$, $\mathbf{18}_2$, . . . , $\mathbf{18}_{i-1}$ whose length is indicative of a time duration during which laser beam 12 has its transmission interrupted. Naturally, the sequence consisting of transmissions $16_1$, $16_2$, . . . and interruptions $18_1$, $18_2$, . . . may be repeated as desired. Both transmission times and interruption times are selected to be lengths of time that are easily distinguishable with the naked eye, i.e, on the order of seconds. Accordingly, it is to be understood that the output of mirror mechanism 14 will appear as either the presence or absence of a laser beam and that the representation of simultaneously viewed transmissions $16_1$, $16_2$, . . . and interruptions $18_1$, $18_2$, . . . is for purposes of description only.

In order to make laser beam transmissions $16_1$, $16_2$, . . . visible from afar as well as safe for the human eye to view, transmissions $16_1$, $16_2$, . . . are passed through a beam expander 20. Beam expander 20 may be any conventional lens arrangement equivalent to a reversed astronomical telescope used to expand the diameter of transmissions $16_1$, $16_2$, . . . and output expanded beam transmissions $22_1$, $22_2$, . . . in correspondence therewith. The amount of beam diameter expansion is predicated on the power of laser 10, the distance the expanded beam transmission $22_1$, $22_2$, . . . must travel, and eye safety requirements. For example, a 1 watt laser may be safely viewed when expanded to a 10 inch diameter beam, while a 4 watt laser must be expanded to a 20 inch diameter beam in order to be viewed safely by the naked eye. The propagation distance of the laser beam, as well as the distance from which the beam is visible, will vary with atmospheric conditions (e.g., haze, fog, rain, etc.).

In operation, expanded beam transmissions $22_1$, $22_2$, . . . are beamed from the entrance of a marine channel and project along the channel's centerline. A projection height above the level of marine traffic is chosen so that expanded beam transmissions $22_1$, $22_2$, . . . are not obstructed. Use of the present invention will now be explained with further reference to FIGS. 2–3 showing the view from on board a ship 30.

Figure 2:
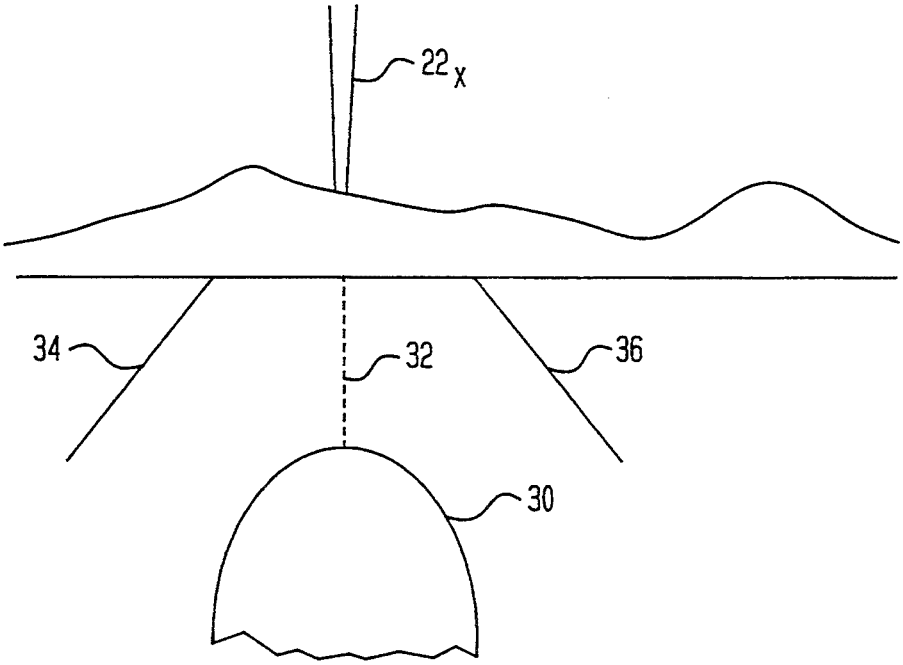
FIG. 2 is a view from on board a ship traveling in a channel marked in accordance with the present invention.
Figure 3:
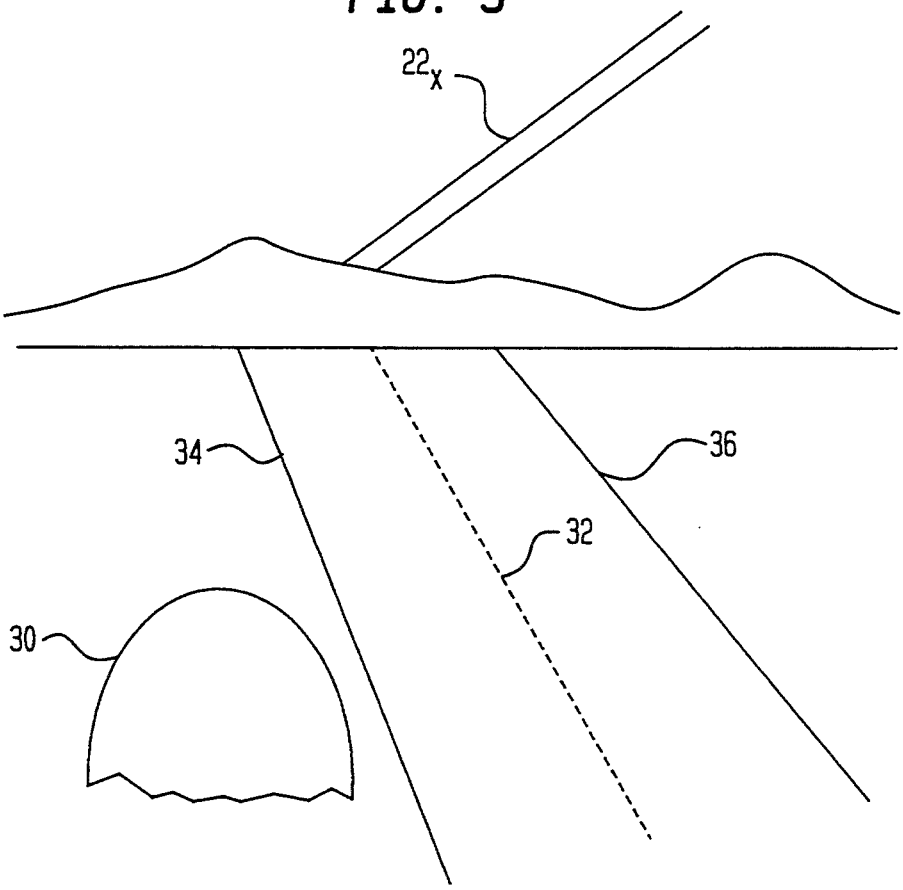
FIG. 3 is a view from on board a ship traveling outside a channel marked in accordance with the present invention.

As shown in FIG. 2, ship 30 is traveling on course with respect to centerline 32 of a marine channel defined by lines 34 and 36. One of expanded beam transmissions $22_x$ is shown passing over ship 30 to highlight the center of the channel and its bearing with respect to ship 30. In FIG. 3, ship 30 is generally heading in the direction of expanded beam transmission $22_x$ but is not within the channel. Owing to the visibility of transmission $22_x$ from all directions, ship 30 can adjust its course to correctly enter the channel on course. Further since transmission $22_x$ is part of a distinguishable sequence, the sequence may be used to locally identify the particular channel by merely visually monitoring the beam transmission and interruption times. For example, beam transmission and interruption times may be selected using well known coding schemes such as those commonly used for light houses and lighted navigation buoys.

As mentioned above, laser 10 outputs a laser beam having a wavelength in the range of 475–540 nanometers. It has been found that light in this range strikes an optimum balance between long distance (i.e., on the order of miles) propagation through the atmosphere, degree of scattering necessary to make the beam visible in the marine environment and the sensitivity of the human eye.

The advantages of the above described method and system are numerous. The requirement of only one laser allows the approach to optimize laser color for range, visibility and safety. In contrast, prior art two color systems must always compromise and operate with the fact that one of the colors will not perform as well as the other color. Furthermore, requiring two colors may mean that both colors must be compromised in terms of visibility in order to achieve a suitable human eye distinguishable contrast level between the two colors.

The beam transmission and interruption times are selected such that human monitoring of same can provide an indication of channel identity. In addition, since the expanded beam transmission may be viewed by ships in or out of the marked channel, ships can identify marked channels before entering same.

Figure 4:
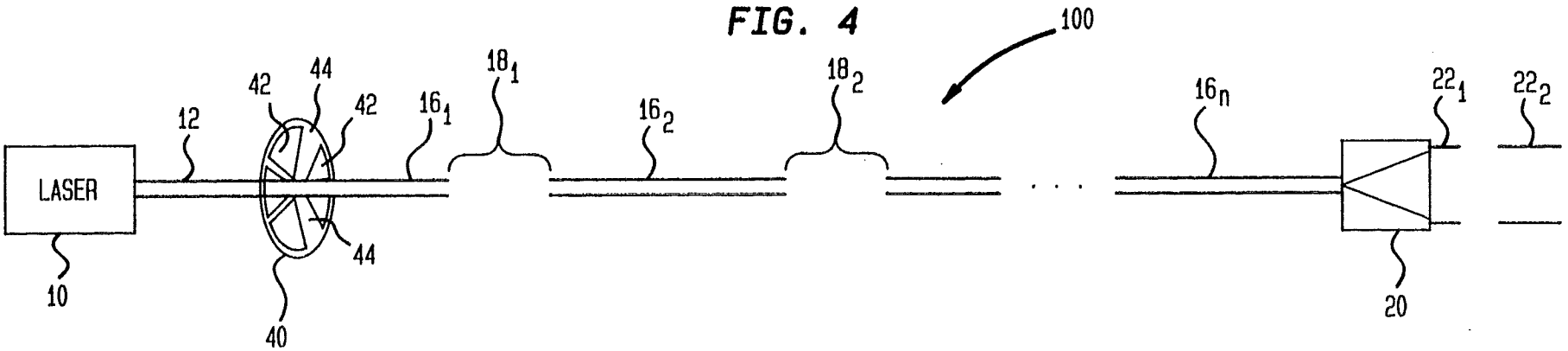
FIG. 4 is a functional block diagram of a single laser marine channel marking system that mechanically interrupts the laser beam in accordance with the present invention.

Finally, although the present invention has been described relative to a specific embodiment, it is not so limited. For example, the timer-controlled beam interruption provided by mirror mechanism 14 in FIG. 1 may be replaced by any mechanical beam interruption device. One such device is shown in FIG. 4 where a simple rotating disk 40 is placed in the path of laser beam 12. Disk 40 is provided with both perforations 42 and laser impermeable portions 44. Perforations 42 provide for laser beam transmissions $16_1$, $16_2$, . . . while laser impermeable portions provide for laser beam interruptions $18_1$, $18_2$, . . . as disk 40 rotates through laser beam 12. Design of disk 40 may be such that one full sequence of transmissions and interruptions used to mark a channel is created by one or more rotations of disk 40 (or less than one rotation).

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for marking and identifying marine channels, comprising:

a laser generating a single continuous wave laser beam in the visible frequency spectrum;

means for selectively interrupting said laser beam to produce an on/off laser beam sequence that uniquely identifies a marine channel, said on/off laser beam sequence defined by specifically timed periods of laser beam transmission distinguishable by the human eye separated by specifically timed periods of laser beam interruption distinguishable by the human eye;

a beam expander for expanding said laser beam in terms of beam diameter during said specifically timed periods of laser beam transmission, and for projecting said expanded laser beam along a beam path that is substantially along the center of a marine channel at a height above the water's surface, wherein marine traffic may pass under said beam path without obstructing said beam path.

2. A system as in claim 1 wherein said laser beam has a wavelength in the range of 475–540 nanometers.

3. A system as in claim 1 wherein said means for selectively interrupting comprises a laser impermeable rotating disk having sequenced perforations for allowing said laser beam to pass therethrough in correspondence with said specifically timed periods of laser beam transmission.

4. A system as in claim 1 wherein said means for selectively interrupting comprises a timer-controlled mirror mechanism.

5. A method for marking and identifying marine channels, comprising the steps of:

generating a single laser beam in the visible frequency spectrum;

selectively interrupting said laser beam to produce an on/off laser beam sequence that uniquely identifies a marine channel, said on/off laser beam sequence defined by specifically timed periods of laser beam transmission distinguishable by the human eye separated by specifically timed periods of laser beam interruption distinguishable by the human eye;

expanding said laser beam in terms of beam diameter during said specifically timed periods of laser beam transmission; and projecting said expanded laser beam along a beam path that is substantially along the center of a marine channel at a height above the water's surface, wherein marine traffic may pass under said beam path without obstructing said beam path.

6. A method according to claim 5 wherein said laser beam is a continuous laser beam.

7. A method according to claim 5 wherein said laser beam is a single color.

8. A method according to claim 7 wherein said single color has a wavelength in the range of 475–540 nanometers.

9. A method according to claim 5 wherein said height is in the range of 80–120 feet.

10. A method according to claim 5 wherein said laser beam diameter is expanded based on power of said laser beam, length of said marine channel to be marked and eye safety requirements.

11. A method according to claim 5 wherein said on/-off laser beam sequence is repeatable.

* * * * *